United States Patent [19]

Tack et al.

[11] Patent Number: 4,874,394

[45] Date of Patent: Oct. 17, 1989

[54] CRUDE OIL AND FUEL OIL COMPOSITIONS

[75] Inventors: Robert D. Tack, Oxford; Rodger F. Andrews, Didcot; Sally J. Ayres, Stanton Harcourt, all of United Kingdom

[73] Assignee: Exxon Chemical Patents Inc., Linden, N.J.

[21] Appl. No.: 146,976

[22] Filed: Jan. 22, 1988

[30] Foreign Application Priority Data

Jan. 27, 1987 [GB] United Kingdom ..... 87-01696

[51] Int. Cl.[4] ..... C10L 1/18

[52] U.S. Cl. ..... 44/70; 44/71; 44/72; 44/73; 44/76

[58] Field of Search ..... 44/70, 71

[56] References Cited

U.S. PATENT DOCUMENTS

| | | | |
|---|---|---|---|
| 2,331,381 | 10/1943 | Gaylor | 44/70 |
| 2,379,252 | 6/1945 | Muskat et al. | 44/70 |
| 2,821,539 | 1/1958 | Newman et al. | 44/70 |
| 2,844,448 | 7/1958 | Heisler et al. | 44/70 |
| 2,844,449 | 7/1958 | Dille et al. | 44/70 |
| 2,844,450 | 7/1958 | Heisler et al. | 44/70 |
| 2,935,479 | 5/1960 | Oberdorfer | 44/70 |
| 3,001,941 | 9/1961 | Dille et al. | 44/70 |
| 3,047,374 | 7/1962 | Condo, Jr. | 44/70 |
| 3,282,662 | 11/1966 | Henderson | 44/70 |
| 3,579,561 | 5/1971 | Meltsher | 44/70 |
| 4,231,758 | 11/1980 | Kablaoui | 44/70 |
| 4,302,215 | 11/1981 | Lewis | 44/70 |
| 4,380,455 | 4/1983 | Smith | 44/70 |

*Primary Examiner*—William R. Dixon, Jr.
*Assistant Examiner*—Ellen M. McAvoy
*Attorney, Agent, or Firm*—R. A. Maggio

[57] ABSTRACT

A crude oil or fuel oil composition comprises a major proportion by weight of a crude oil or a fuel oil and a minor proportion by weight of a polycarbonate containing the group

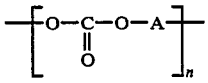

where n is an integer of two or more and A is an alkylene, aralkylene or arylene radical, provided the alkylene group can be interrupted by one or more hetero atoms or by one or more carboxylic ester, carbamoyl, urethane, urea or tertiary amino groups. A typical polycarbonate has the formula

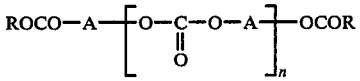

where R are $C_{10}$ to $C_{30}$ alkyl groups.

17 Claims, No Drawings

CRUDE OIL AND FUEL OIL COMPOSITIONS

This invention relates to crude oil and fuel oils to which a flow improver has been added.

When crude oils and fuel oils are subjected to low ambient temperatures, especially in northern European countries, wax will separate out and impair the flow properties unless a cold flow improver is added. The effectiveness of such additives can be measured by tests such as the CFPP and PCT and the depression of cloud point and wax appearance point can also be determined.

At the moment ethylene/vinyl acetate copolymers, prepared by free radical polymerisation are now the most economical distillate fuel flow improvers (DFFI's). However they could be further improved if the detailed alkylene group sequences in the backbone could be closely controlled. However this is not possible in the free radical polymerisation process. If such control of said sequences could be established the flow improvers would be of great interest for cold flow improvement of fuels which do not respond to conventional ethylene-vinyl acetate copolymer flow improvers.

We have now discovered economical cold flow improvers where the alkyl group sequences can be closely controlled and which may be obtained as low molecular weight polymers when required. These flow improvers are certain specified polycarbonates, and by terminal capping can be useful as wax crystal nucleators. According to this invention a crude oil or fuel oil composition comprises a major proportion by weight of a crude oil or a fuel oil and a minor proportion by weight of a polycarbonate containing the group.

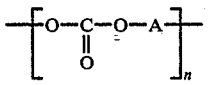

where n is an integer of two or more and A is an alkylene, aralkylene or arylene radical, provided the alkylene group can be interrupted by one or more hetero atoms or by one or more carboxylic ester, carbamoyl, urethane, urea or tertiary amino group n is usually between 2 and 5.

This invention also provides the use as a flow improver in a crude oil or a fuel oil of the above defined polycarbonate.

Although the polycarbonates may be used as flow improvers in crude oils, i.e. oils as obtained from drilling and before refining, they are preferably used as flow improvers in liquid hydrocarbon fuels, especially distillate fuel oils. The liquid hydrocarbon fuel oils can be the middle distillate fuel oils, e.g. a diesel fuel, aviation fuel, kerosene, fuel oil, jet fuel, heating oil, etc. Generally, suitable distillate fuels are those boiling in the range of 120° to 500° C. (ASTM D86), preferably those boiling in the range 150° to 400° C. A representative heating oil specification calls for a 10% distillation point no higher than about 226° C., a 50% point no highe than about 272° C. and a 90% point of at least 282° C. and a final boiling point no higher than about 338° C. to 343° C., although some specifications set the 90% point as high as 357° C. Heating oils are preferably made of a blend of virgin distillate, eg gas oil, naphtha, etc. and cracked distillates, eg catalytic cycle stock.

The polycarbonates of the formula

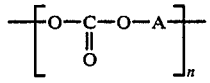

are usually prepared by the transesterification-polymerisation of a dihydric phenol, a diol or a mixture of phenols and/or diols with a dialkyl carbonate. In this way polycarbonates can be prepared which contain designed alkyl group sequences. As is also the case with polyesterification this type of polymerisation is easily controllable so that low molecular weight polymers may be produced easily. If capping compounds, eg long chain alcohols, are included in designed proportions with the phenols and/or diols this leads to an absolute control of the average molecular weight and to polymers with terminal long alkyl groups: Such polymers are useful as wax crystal nucleators. If a mixture of linear alpha-omega diols and branched diols are used there is a further control on the polycarbonate solubility in oil and these are useful as wax crystal growth inhibitors.

The simplest polycarbonates are those of the formula

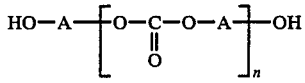

where A and n are as previously defined.

Various examples of the group A are as follows:

Alkylene radicals containing at least 3 carbon atoms: the propylene-(1,3), butylene-(1,4) pentamethylene(1,5), hexamethylene-(1,6) and octamethylene-(1,8) radicals.

Alkylene radicals which contain at least 3 carbon atoms and are interrupted by hetero atoms such as oxygen, sulphur and nitrogen or other groups, primarily alkylene radicals interrupted by ether, thioether, carboxylic ester, carbamoyl, urethane, urea and tertiary amino groups.

Cycloalkylene radicals, primarly the cyclohexylene radical.

Arylene radicals, primarily the 1,4-phenylene and 2,2-diphenylpropane-(4,4')-diyl radicals.

Aralkylene radicals, primarily the 1,4-xylylene radical.

In general it is preferred that A is a polymethylene group having 2 to 18 preferably 2 to 12, e.g. 3 to 10, carbon atoms, 2 to 4 carbon atoms being preferred, i.e. ethylene, propylene or butylene.

These polycarbonates may be simply prepared by transesterification-polymerisation-of a diol preferably with primary alcohol groups with a dialkyl carbonate or diarylcarbonate. Although various dialkyl carbonates may be used, for example di($C_1$–$C_{10}$) alkyl carbonates such as dimethyl carbonate, di-n-propyl carbonate, di-n-hexyl carbonate or di-n-decyl carbonate it is preferred to use diethyl carbonate.

A typical reaction is as follows:

$$n(C_2H_5O)_2C{=}O + (n+1)HO(CH_2)_4OH \xrightarrow{\text{catalyst}} 2^n\ C_2H_5OH$$

-continued

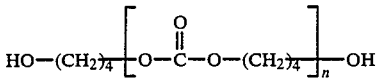

Thus, 5 to 15% excess of diol per mole of carbonate may be used.

The catalyst which may be used in this and other reactions is metallic sodium, potassium or lithium or an alkali metal alkoxide. The amount of metallic sodium may be 0.005% by weight. The reaction mixture may be heated to distil off alcohol as a by-product as well as unreacted diethyl carbonate, eg heating to 120° C. to distil off ethanol when using diethyl carbonate.

It is preferred that the terminal hydroxyl groups of these polyglycols can be esterified with a carboxylic acid preferably an aliphatic mono carboxylic acid, eg having 10 to 30 carbon atoms per molecule to improve their solubility in the fuel. Suitable examples are n-decanoic acid, n-tetradecanoic acid, stearic acid, n-octadecanoic acid, n-eicosanoic acid and behenic acid.

The simplest carboxylic acid-capped polycarbonates are those of the formula

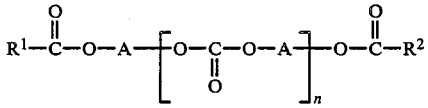

where A and n are as defined before and $R^1$ and $R^2$ are the same or different hydrocarbyl, eg alkyl groups, preferably long chain alkyl groups of for example 10 to 30 carbon atoms.

Alternatively they can be capped by an alcohol.

Suitable examples of A are as exemplified above and suitable groups $R^1$ and $R^2$ include n-decyl, n-tetradecyl, n-octadecyl, n-eicosyl, n-tetracosyl, as well as the branched analogues. $R^1$ and $R^2$ could be alkaryl or aralkyl groups, eg xylyl or tolyl groups.

A typical reaction is as follows:

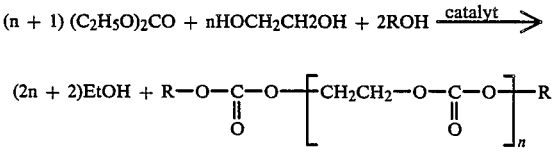

An example of a polycarbonate having a mixture of a linear A group ($A^1$) and a branched A group ($A^2$), eg linear alkylene and branched alkylene groups, is as follows:

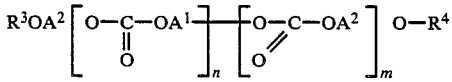

where n, $A^1$ and $A^2$ are as defined above, m is zero or an integer and $R^3$ and $R^4$ which may be the same or different are a hydrogen atom or a hydrocarbyl group, e.g. an alkyl group. When $R^3$ and/or $R^4$ are hydrocarbyl groups, i.e. the polycarbonate is capped, $R^3$ and/or $R^4$ are preferably alkyl groups and suitable examples are as given for $R^1$ and $R^2$ above.

The ratio of m and n is determined by the relative proportions of the diols and/or dyhydric phenols from which groups $A^1$ and $A^2$ are derived.

A typical reaction is as follows:

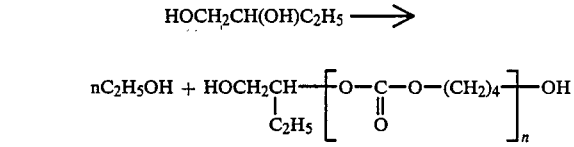

Of course if desired the polycarbonate may have other groups, eg groups derived from a triol provided it also contains the defined group

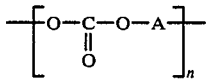

The molecular weight of the polycarbonates can vary but average molecular weights (determined by GPC) of from 300 to 3000, in particular 500 to 1000 are particularly suitable.

The amount of polycarbonate added to the crude oil or fuel oil can vary but generally it is from 0.001 to 5.0 wt%, preferably 0.001 to 0.5 wt%, especially 0.01 to 0.05 wt% (active matter) based on the weight of crude oil or fuel oil.

The crude oil or fuel oil can also include other additives and in particular copolymers of vinyl acetate and an alkyl fumarate, especially a dialkyl fumarate, the alkyl group(s) having 10 to 30 carbon atoms, for example 10 to 18, eg dodecyl, tetradecyl, hexadecyl or octadecyl. The fumarate monomer may be a mixture of dialkyl fumarates, a mixture of $C_{12}$ to $C_{14}$ dialkyl fumarates being especially preferred. The mole ratio of vinyl acetate to dialkyl fumarate usually lies between 0.8:1 and 1.2:1 and the molecular weight usually lies between 5,000 and 100,000.

The weight ratio of polycarbonate to vinyl acetate/dialkyl fumarate copolymers can vary but it is usually between 1:2 to 1:5, eg 1:3.

The polycarbonates may be used together with what are known as comb polymers of the general formula

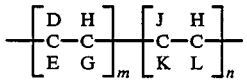

where

D=R, CO.OR, OCO.R, R'CO.OR or OR

E=H or $CH_3$ or D or R'

G=H, or D m=10 (homopolymer) to 0.4 (mole ratio)

J=H, R', Aryl or Heterocyclic group, R'CO.OR

K=H, CO.OR', OCO.R', OR', $CO_2H$

L=H, R', CO.OR', OCO.R', Aryl, $CO_2H$ n=0.0 to 0.6 (mole ratio)

$R \geqq C_{10}$ $R' \geqq C_1$

Another monomer may be terpolymerized if necessary

Examples of suitable comb polymers are the fumarate/vinyl acetate particularly those described in our European Patent Applications 0153176, 0153177, 85301047 and 85301048 and esterified olefine/maleic anhydride copolymers and the polymers and copolymers of alpha olefins and esterified copolymers of styrene and maleic anhydride.

Examples of other additives with which the compounds of the present invention may be used are the polyoxyalkylene esters, ethers, ester/ethers and mixtures thereof, particularly those containing at least one, preferably at least two $C_{10}$ to $C_{30}$ linear saturated alkyl groups and a polyoxyalkylene glycol group of molecular weight 100 to 5,000 preferably 200 to 5,000, the alkyl group in said polyoxyalkylene glycol containing from 1 to 4 carbon atoms. These materials form the subject of European Patent Publication No. 0,061,895 A2. Other such additives are described in U.S. Pat. No. 4,491,455.

The preferred esters, ethers or ester/ethers which may be used may be structurally depicted by the formula:

$$R—O(A)—O—R''$$

where R and R'' are the same or different and may be

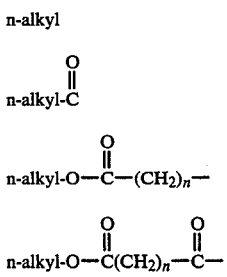

(i) n-alkyl (ii) n-alkyl-C(=O)

(iii) n-alkyl-O—C(=O)—$(CH_2)_n$—

(iv) n-alkyl-O—C(=O)$(CH_2)_n$—C(=O)— the alkyl group being linear and saturated and containing 10 to 30 carbon atoms, and A represents the polyoxyalkylene segment of the glycol in which the alkylene group has 1 to 4 carbon atoms, such as polyoxymethylene, polyoxyethylene or polyoxytrimethylene moiety which is substantially linear; some degree of branching with lower alkyl side chains (such as in polyoxypropylene glycol) may be tolerated but it is preferred the glycol should be substantially linear, A may also contain nitrogen.

Suitable glycols generally are the substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives and it is preferred to use a $C_{18}$–$C_{24}$ fatty acid, especially behenic acids. The esters may also be prepared by esterifying polyethoxylated fatty acids or polyethoxylated alcohols.

Polyoxyalkylene diesters, diethers, ether/esters and mixtures thereof are suitable as additives with diesters preferred for use in narrow boiling distillates whilst minor amounts of monoethers and monoesters may also be present and are often formed in the manufacturing process. It is important for additive performance that a major amount of the dialkyl compound is present. In particular, stearic or behenic diesters of polyethylene glycol, polypropylene glycol or polyethylene/polypropylene glycol mixtures are preferred.

The compounds of this invention may also be used with ethylene unsaturated ester copolymer flow improves. The unsaturated monomers which may be copolymerised with ethylene include unsaturated mono and diesters of the general formula:

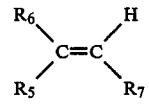

wherein $R_6$ is hydrogen or methyl, $R_5$ is a —$OOCR_8$ group wherein $R_8$ is hydrogen or a $C_1$ to $C_{28}$, more usually $C_1$ to $C_{17}$, and preferably a $C_1$ to $C_8$, straight or branched chain alkyl group; or $R_5$ is a —$COOR_8$ group wherein $R_8$ is as previously described but is not hydrogen and $R_7$ is hydrogen or —$COOR_8$ as previously defined. The monomer, when $R_6$ and $R_7$ are hydrogen and $R_5$ is —$OOCR_8$, includes vinyl alcohol esters of $C_1$ to $C_{29}$, more usually $C_1$ to $C_5$, monocarboxylic acid, and preferably $C_2$ to $C_{29}$, more usually $C_1$ to $C_5$ monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. We prefer that the copolymers contain from 5 to 40 wt.% of the vinyl ester, more preferably from 10 to 35 wt.% vinyl ester. They may also be mixtures of two copolymers such as those described in U.S. Pat. No. 3,961,916. It is preferred that these copolymers have a number average molecular weight as measured by vapour phase osmometry of 1,000 to 10,000, preferably 1,000 to 5,000.

The compounds of the invention may also be used in distillate fuels in combination with other polar compounds, either ionic or non-ionic, which have the capability in fuels of acting as wax crystal growth inhibitors. Polar nitrogen containing compounds have been found to be especially effective when used in combination with the glycol esters, ethers or ester/ethers and such three component mixtures are within the scope of the present invention. These polar compounds are generally amine salts and/or amides formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally containing about 30 to 300 total carbon atoms. The nitrogen compound preferably contains at least one straight chain $C_8$ to $C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctacedyl amine, methylbehenyl amine and the like. Amine mixtures are also suitable and many amines derived from natural materials are mixtures. The preferred amine is a secondary hydrogenated tallow amine of the formula $HNR_1R_2$ where in $R_1$ and $R_2$ are alkyl groups derived from hydrogenated tallow fat composed of approximately 4% $C_{14}$, 31% $C_{16}$, 59% $C_{18}$. Examples of suitable carboxylic acids and their anhydrides for preparing these nitrogen compounds include cyclohexane, 1,2 dicarboxylic acid, cyclohexene, 1,2-dicarboxylic acid, cyclopentane 1,2 dicarboxylic acid, naphthalene dicarboxylic acid and the like. Generally, these acids will have about 5–13 cabon atoms in the cyclic moiety. Preferred acids useful in the present invention are benzene dicarboxylic acids such as phthalic acid, isophthalic acid, and terephthalic acid. phthalic acid or its anhydride is particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Hydrocarbon polymers may also be used as part of the additive combination which may be represented with the following general formula:

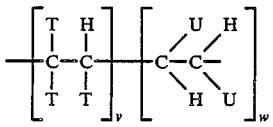

where

T=H or R'

U=H, T or Aryl v=1.0 to 0.0 (mole ratio)

w=0.0 to 1.0 (mole ratio)

where $R^1$ is alkyl.

These polymers may be made directly from ethylenically unsaturated monomers or indirectly by hydrogenating the polymer made from monomers such as isoprene, butadiene etc.

A particularly preferred hydrocarbon polymer is a copolymer of ethylene and propylene having an ethylene content preferably between 20 and 60% (w/w) and is commonly made via homogeneous catalysis.

The additives may also be used together with the compounds of our European Patent Application 87308435.4 which are of the general formula

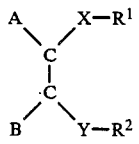

in which

—Y—$R^2$ is $SO_3^{(-)(+)}NR^3R^2$, —$SO_3^{(31)(+)}HNR^3R^2$, —$SO_3^{(-)(+)}H_2NR^3R^2$, —$SO_3^{(-)(+)}H_3NR^2$, —$SO_2NR^3R^2$ or —$SO_3R^2$;

—X—$R^1$ is —Y—$R^2$ or —$CONR^3R^1$, —$CO_2^{(-)(+)}NR_3{}^3R^1$, —$CO_2^{(-)(+)}HNR_2{}^3R^1$, —$CO_2^{(-)(+)}H_2NR^3R^1$, —$CO_2^{(-)(+)}H_3NR^1$, —$R^4$—$COOR_1$, —$NR^3COR^1$, $R^4OR^1$, —$R^4OCOR^1$, —$R^4R^1$, —$N(COR^3)R^1$ or $Z^{(-)(+)}NR_3{}^3R^1$;

—$Z^{(-)}$ is $SO_3^{(-)}$ or —$CO_2^{(-)}$;

$R^1$ and $R^2$ are alkyl, alkoxy alkyl or polyalkoxy alkyl containing at least 10 carbon atoms in the main chain;

$R^3$ is hydrocarbyl and each $R^3$ may be the same or different and $R^4$ is nothing or is $C_1$ to $C_5$ alkylene and in

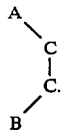

The carbon-carbon (C—C) bond is either (a) ethylenically unsaturated when A and B may be alkyl, alkenyl or substituted hydrocarbyl groups or (b) part of a cyclic structure which may be aromatic, polynuclear aromatic or cyclo-aliphatic.

It is preferred that —X—$R^1$ and —Y—$R^2$ contain at least three alkyl and/or alkoxy groups.

The ring atoms in such cyclic compounds are preferably carbon atoms, but could, however, include a ring N, S or O atom to give a heterocyclic compound.

Examples of aromatic based compounds from which the additives may be prepared are

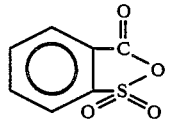

in which the aromatic group may be substituted.

Alternatively they may be obtained from polycyclic compounds, that is those having two or more ring structures which can take various forms. They can be (a) condensed benzene structures, (b) condensed ring structures where none or not all rings are benzene, (c) rings joined "end-on", (d) heterocyclic compounds (e) non-aromatic or partially saturated ring systems or (f) three-dmensional structures.

Condensed benzene structures from which the compounds may be derived include for example naphthalene, anthracene, phenathrene and pyrene. The condensed ring structures where none or not all rings are benzene include for example Azulene, Indene, Hydroindene, Fluorene, Diphenylene. Compounds where rings are joined end-on include diphenyl.

Suitable heterocyclic compounds from which they may be derived include Quinoline; Indole 2:3 dihydroindole, benzofuran, coumarin and isocoumarin, benzothiophen, carbazole and thiodiphenylamine.

Suitable non-aromatic or partially saturated ring systems include decalin (decahydronaphthalene), pinene, cadinene, bornylene. Suitable 3-dimensional compounds include norbornene, bicycloheptane (norbornane), bicyclo octane and bicyclo octene.

The two substituents must be attached to adjoining ring atoms in the ring when there is only one ring or to adjoining ring atoms in one of the rings where the compound is polycyclic. In the latter case this means that if one were to use naphthalene, these substituents could not be attached to the 1,8- or 4,5-positions, but would have to be attached to the 1,2-, 2,3-, 3,4-, 5,6-, 6,7- or 7,8-positions.

The additive systems which form part of the present invention may conveniently be supplied as concentrates for incorporation into the bulk distillate fuel. These concentrates may also contain other additives as required. These concentrates preferably contain from 3 to 75 wt.%, more preferably 3 to 60 wt.%, most preferably 10 to 50 wt.% of the additives, preferably in solution in oil. Such concentates are also within the scope of the present invention. The additives of this invention may be used in the broad range of disillate fuel boiling in the range 120° to 500° C.

EXAMPLES 1 TO 15

In these Examples a series of polycarbonates was prepared by transesterifying the diol shown in Table 1 with diethylene carbonate. In each case the terminal hydroxyl groups were esterified with behenic acid. The MW in each case as determined by GPC is given in the Table.

To test the polycarbonates as nucleators they were added at a concentration of 250 ppm (active matter) to a distillate fuel oil having the following characteristics.

| Cloud/°C. | WAP/°C. | % Wax at −10° C. | Highest Wax by GLC |
|---|---|---|---|
| −2 | −5 | 5 | 25 |

| ASTM D86, °C. | | | | | | |
|---|---|---|---|---|---|---|
| IBP | 20% | 50% | 90% | FBP | 90 − 20% | Tail |
| 202 | 270 | — | 328 | 343 | 58 | 15 |

Each blend of fuel and polycarbonate also contained 750 ppm of a copolymer of vinyl acetate and a di($C_{12}$–$C_{14}$) alkyl fumarate ester.

Each blend was then subjected to the Cold Filter Plugging Point Test (CFPPT) details of which are as follows:

The Cold Filter Plugging Point Test (CFPPT)

The cold flow properties of the blend were determined by the Cold Filter Plugging Point Test (CFPPT). This test is carried out by the procedure described in detail in 'Journal of the Institute of Petroleum', Vol. 52, No. 510, June 1966 pp 173–185. In brief, a 40 ml. sample of the oil to be tested is cooled by a bath maintained at about −34° C. Periodically (at each one degree Centigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette to a mark indicating 20 of oil. The test is repeated with each one degree drop in temperature until the oil fails to fill the pipette within 60 seconds. The results of the test are quoted as CFPP (°C.) which is the fail temperature of the fuel treated with the flow improver.

The results obtained are shown in the following Table. 1.

TABLE 1

| Example | Diol | Mn (By GPC) | CFPP °C. (Average) |
|---|---|---|---|
| 1 | 1,6-hexanediol | 1760 | −4.5 |
| 2 | 1,4-butanediol | 1050 | −5 |
| 3 | 1,4-butanediol and 1,6-hexanediol (1:1) | 1700 | −6.5 |
| 4 | 1,4-butanediol and diethylene glycol (1:1) | 1500 | −7 |
| 5 | 1,4-cyclohexanedimethanol and triethylene glycol | 690 | −8 |
| 6 | Diethylene glycol | 1000 | −8 |
| 7 | 1,4-butanediol and triethylene glycol (1:1) | 1090 | −8 |
| 8 | 1,6-hexanediol and diethylene glycol (1:1) | 1430 | −9.5 |
| 9 | 1,6-hexanediol and triethylene glycol (1:1) | 1300 | −9.5 |
| 10 | Diethylene and triethylene glycol (1:1) | 1100 | −10 |
| 11 | Diethylene glycol | 590 | −10.5 |
| 12 | Triethylene glycol | 1025 | −11 |
| 13 | Diethyelen glycol and triethylene glycol | 960 | −11 |
| 14 | Dialysate (1) of diethylene glycol: triethylene glycol mix | 1100 | −11.5 |
| 15 | Triethylene glycol | 570 | −12 |
| 16 | Polyethylene glycol of MW about 200 | 1000 | −11 |

(1) Dialysate is the lower molecular weight portion of the polycarbonate of EX.10

For the fuel oil alone the CFPP was −4.5° C. and for the fuel oil plus the vinyl acetate copolymer (750 ppm) it was −3° C. It can be seen therefore that the polycarbonates show good properties as nucleators.

We claim:

1. A wax containing oil composition comprising (a) crude oil or fuel oil and (b) a wax crystal modifying amount of at least one polycarbonate having a number average molecular weight from about 300 to about 3000 and represented by the structural formula:

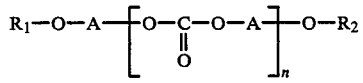

wherein $R_1$ is selected from the group consisting of hydrogen, alkyl, alkoxy carbonyl, alkyl carbonyl, aralkyl, aralkoxycarbonyl, aralkylcarbonyl, alkaryl, alkaryl oxy carbonyl, and alkaryl carbonyl; $R_2$ is independently selected from the same groups defined in connection with $R_1$ provided $R_2$ may not be alkoxy carbonyl, aralkoxy carbonyl or alkaryloxy carbonyl; A is independently selected from the group consisting of $C_3$ to about $C_{18}$ alkylene, cycloalkylene, and arylene, provided that when A is alkylene, it can be interrupted by a bridging group selected from the group consisting of oxy, thio, amido ureylene, carbamate and tertiary amino; and n is a number greater than 2.

2. The composition of claim 1 wherein $R_1$ is selected from the group consisting of hydrogen, $C_{10}$ to about $C_{30}$ alkyl, $C_{10}$ to about $C_{30}$ alkoxy carbonyl, and $C_{10}$ to about $C_{30}$ alkyl carbonyl; $R_2$ is selected from the group consisting of $C_{10}$ to about $C_{30}$ alkyl, $C_{10}$ to about $C_{30}$ alkyl carbonyl and hydrogen; and A is not interrupted by a bridging group and is $C_3$ to about $C_{18}$ alkylene.

3. The composition of claim 2 wherein n is at least 4.

4. The compostion of claim 2 wherein $R_1$ and $R_2$ are hydrogen.

5. The composition of claim 2 wherein $R_1$ and $R_2$ are alkyl carbonyl.

6. The composition of claim 2 wherein $R_1$ and $R_2$ are alkyl.

7. The composition of claim 2 wherein said oil is a distillate fuel boiling in the range of 120° to 500° C.

8. The composition of claim 2 wherein A is $C_4$ to $C_{18}$ alkylene.

9. An additive concentrate adapted for use in a crude oil or fuel oil as a wax crystal modifier comprising an oil solution of 3 to 75 wt. percent of a polycarbonate represented by the structural formula:

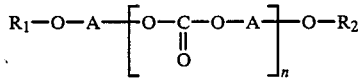

wherein $R_1$ is selected from the group consisting of hydrogen, alkyl, alkoxy carbonyl, alkyl carbonyl, aralkyl, aralkoxycarbonyl, aralkylcarbonyl, alkaryl, alkaryl oxy carbonyl, alkaryl carbonyl; $R_2$ is independently selected from the same groups defined in connection with $R_1$ provided $R_2$ may not be alkoxy carbonyl, aralkoxy carbonyl or alkaryloxy carbonyl; A is independently selected from the group consisting of $C_3$ to about $C_{18}$ alkylene, cycloalkylene, and arylene, provided that when A is alkylene, it can be interrupted by a bridging group selected from the group consisting of oxy, thio, amido ureylene, carbamate and tertiary amino; and n is a number greater than 2.

10. The concentrate of claim 9 wherein $R_1$ is selected from the group consisting of hydrogen, $C_{10}$ to about $C_{30}$ alkyl, $C_{10}$ to about $C_{30}$ alkoxy carbonyl, and $C_{10}$ to about $C_{30}$ alkyl carbonyl; $R_2$ is selected from the group consisting of hydrogen, and $C_{10}$ to about $C_{30}$ alkyl carbonyl; and A is not interrupted by a briding group and is $C_3$ to about $C_{18}$ alkylene.

11. A wax containing oil composition comprising (a) crude oil or fuel oil and (b) a wax crystal modifying amount of at least one polycarbonate having a number average molecular weight from about 300 to about 3000 and represented by the structural formula:

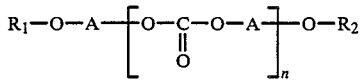

wherein $R_1$ is selected from the group consisting of alkyl carbonyl, aralkylcarbonyl, and alkaryl carbonyl; $R_2$ is independently selected from the same groups defined in connection with $R_1$; A is independently selected from the group consisting of $C_3$ to about $C_{18}$ alkylene, cycloalkylene, and arylene, provided that when A is alkylene, it can be interrupted by a bridging group selected from the group consisting of oxy, thio, amido ureylene, carbamate and tertiary amino; and n is a number of at least 2.

12. The composition of claim 11 wherein $R_1$ is $C_{10}$ to about $C_{30}$ alkyl carbonyl; $R_2$ is $C_{10}$ to about $C_{30}$ alkyl carbonyl; and A is not interrupted by a bridging group and is $C_3$ to about $C_{18}$ alkylene.

13. The composition of claim 12 wherein n is at least 4.

14. The composition of claim 12 wherein said oil is a distillate fuel boiling in the range of 120° to 500° C.

15. The composition of claim 12 wherein A is $C_4$ to $C_{18}$ alkylene.

16. An additive concentrate adapted for use in a crude oil or fuel oil as a wax crystal modifier comprising an oil solution of 3 to 75 wt. percent of a polycarbonate represented by the structural formula:

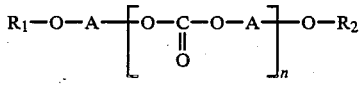

wherein $R_1$ is selected from the group consisting of alkyl carbonyl, aralkylcarbonyl, and alkaryl carbonyl; $R_2$ is independently selected from the same groups defined in connection with $R_1$; A is independently selected from the group consisting of $C_3$ to about $C_{18}$ L *alkylene, cycloalkylene, and arylene, provided that when A is alkylene, it can be interrupted by a bridging group selected from the group consisting of oxy, thio, amido ureylene, carbamate and tertiary amino; and n is a number of at least* 2.

17. The concentrate of claim 16 wherein $R_1$ is $C_{10}$ to about $C_{30}$ alkyl carbonyl; $R_2$ is $C_{10}$ to about $C_{30}$ alkyl carbonyl; and A is not interrupted by a bridging group and is $C_3$ to about $C_{18}$ alkylene.

* * * * *